United States Patent [19]

Fox

[11] 4,178,770

[45] Dec. 18, 1979

[54] COLD AIR FLOW CONTROL APPARATUS

[75] Inventor: Lyle Fox, New Hope, Minn.

[73] Assignee: Econo-Cooler, Inc., Osseo, Minn.

[21] Appl. No.: 899,560

[22] Filed: Apr. 24, 1978

[51] Int. Cl.[2] ..... F25D 17/04

[52] U.S. Cl. ..... 62/186; 62/203; 62/332; 62/412; 165/16; 236/49

[58] Field of Search ..... 62/180, 186, 203, 332, 62/409, 412; 165/16; 236/49; 98/40 VT, 37, 33 A

[56] References Cited

U.S. PATENT DOCUMENTS

| | | | |
|---|---|---|---|
| 1,053,443 | 2/1913 | Scott | 62/235 |
| 2,012,527 | 8/1935 | Batchelder, Jr. | 236/49 |
| 2,057,494 | 10/1936 | Leigh | 236/49 |
| 2,698,570 | 1/1955 | Feinberg | 98/40 VT |
| 2,855,839 | 10/1958 | Tiegen | 98/33 A |
| 3,368,756 | 2/1968 | Edwards | 98/37 |
| 4,023,947 | 5/1977 | Ferry | 62/409 |

*Primary Examiner*—Ronald C. Capossela
*Attorney, Agent, or Firm*—Burd, Braddock & Bartz

[57] ABSTRACT

An apparatus to circulate and regulate the flow of cold air from the exterior of a building having a cold room to the cold room to supplement the refrigeration of the cold room provided by the usual refrigeration equipment. Duct work is provided to carry cool air from the exterior of the building to the cold room, and further duct work is provided to exhaust air from the cold room. One or more blowers operate in conjunction with the duct work to circulate the air through the duct work and through the cold room. The blowers are controlled by temperature controls such that the apparatus can operate only when the temperature outside is below a high temperature limit, and does operate when the temperature in the cold room approaches or exceeds an upper temperature boundary to introduce cold air into the room until a lower temperature boundary is reached.

19 Claims, 6 Drawing Figures

FIG. 3
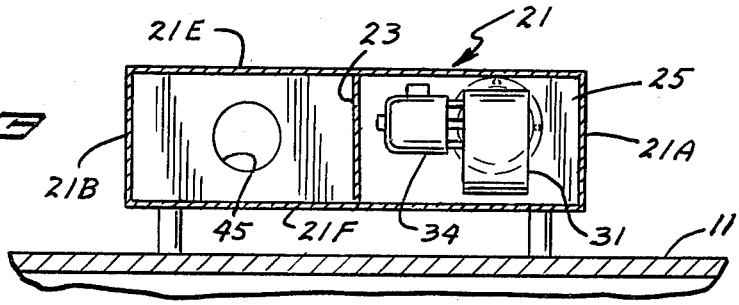
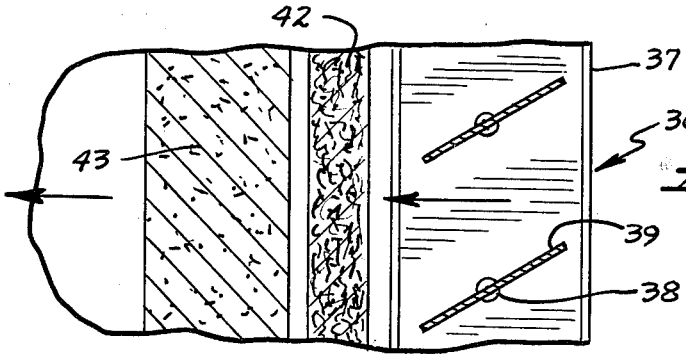
FIG. 4
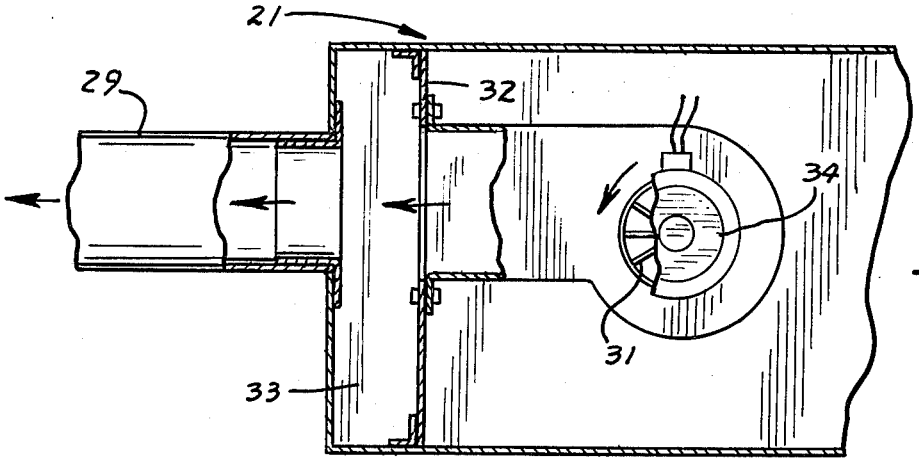
FIG. 5
FIG. 6
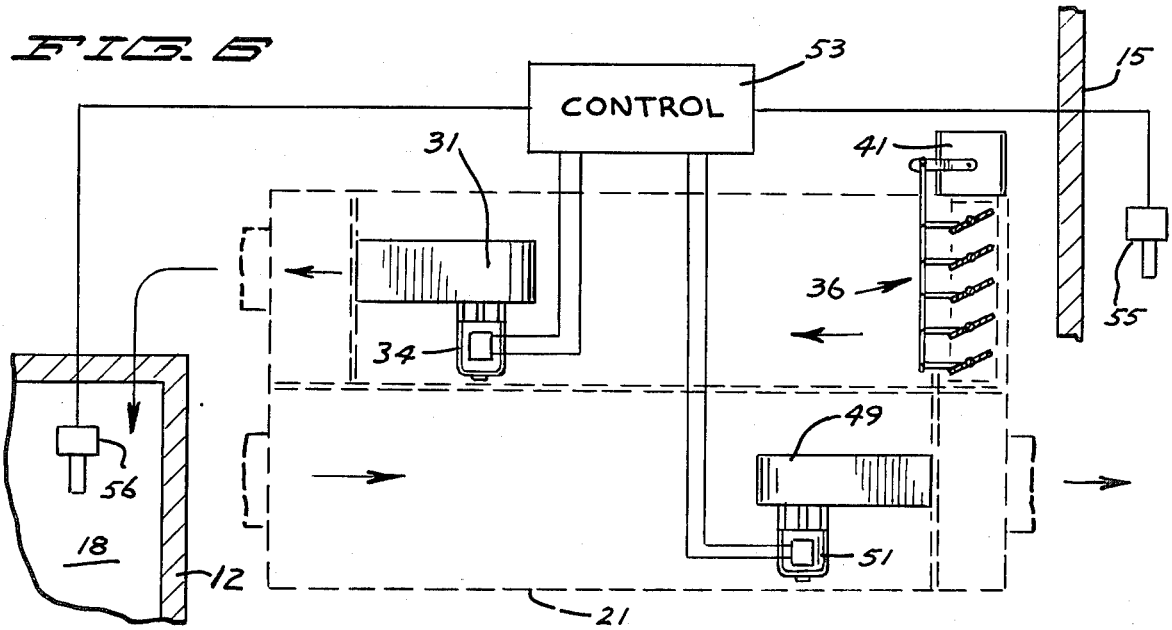

COLD AIR FLOW CONTROL APPARATUS

BACKGROUND OF INVENTION

Many commercial, industrial, and even residential establishments have cold rooms or refrigerated rooms primarily for storage and preservation of food items, as in restaurants, grocery stores, hotels, taverns, hospitals, food processing establishments and the like. The energy requirements of operating such a cold area can be significant. In winter, particularly in northern climates, this results in the anomally that energy is being expended to cool a room in a building that is being heated. In northern climates, during much of the year, the ambient outside temperature of the air is at or below the temperature at which a cold room is normally maintained. Generally the temperature maintained in such cold rooms is above freezing. Storage of food items of the type normally stored in cold rooms directly in an outside environment results in freezing or in alternately freezing and thawing.

SUMMARY OF INVENTION

The invention relates to an apparatus to circulate and regulate the flow of cold air from an outside, cold environment to and through a cold room located in a building heated to a temperature above the ambient outside temperature, such as a restaurant, grocery store, tavern, hotel, or the like. The apparatus saves some of the energy normally expended by refrigeration equipment in keeping a cold room at a low temperature by drawing cold air from an outside location into the cold room to replace warmed air. The apparatus includes intake duct work open to a location outside of the building and also open to the cold room to draw air from the outside location into the cold room. The apparatus also includes exhaust duct work open to the cold room to exhaust warmed air from the cold room. Blowers are associated with the duct work in order to move the air. Temperature controls are associated with the blowers such that when the outside ambient temperature is below an acceptable upper limit, the apparatus can be operated and when the temperature in the cold room approaches or exceeds a high temperature boundary, the apparatus is automatically operated to introduce cold air into the cold room, while expelling warmed air until the temperature inside the cold room drops to a low temperature boundary at which time the apparatus shuts off. Filters can be associated with the intake duct work in order to filter or clean the air as it enters the cold room.

IN THE DRAWINGS

FIG. 3 is a reduced scale sectional view of the cold air flow control apparatus of FIG. 2 taken along the line 3—3 thereof;

FIG. 4 is an enlarged sectional view of a portion of the cold air flow control apparatus of FIG. 2 taken along the line 4—4 thereof;

FIG. 5 is an enlarged sectional view of a portion of the cold air flow control apparatus of FIG. 2 taken along the line 5—5 thereof; and FIG. 6 is a diagrammatic depiction showing the control circuit of the cold air flow control apparatus.

DESCRIPTION OF PREFERRED EMBODIMENT

Figure 1:
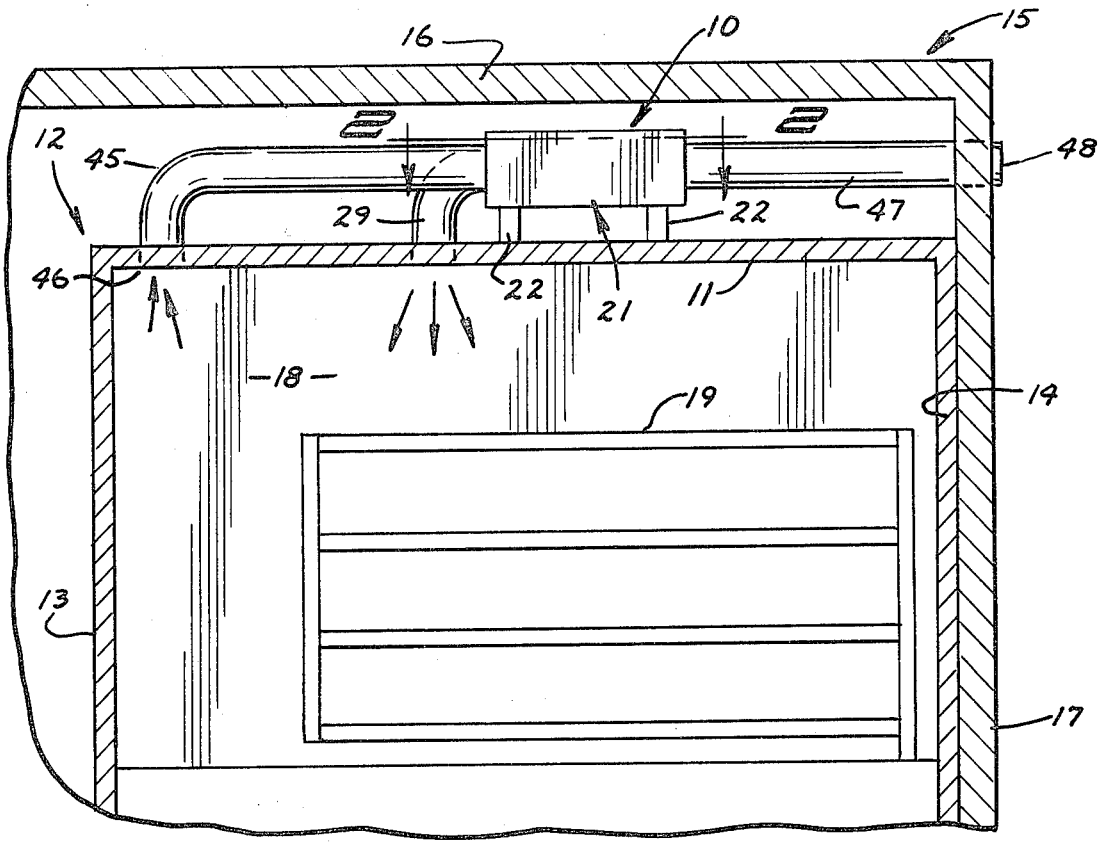
FIG. 1 is a fragmentary view partly in section showing a cold room and the cold air flow control apparatus of the invention both installed in a building.

Referring to the drawings, there is shown in FIG. 1 a cold air flow apparatus of the invention indicated generally at 10 installed on the outside surface of a top wall 11 of a cold room 12 which is further defined by adjacent complementary walls 13 and 14. Cold room 12 is installed inside of a building 15 partially defined by outside building walls 16 and 17. Cold room 12 has a normally closed and insulated interior volume 18 which can contain racks or shelves 19 for the storage of food items or other perishable items which normally require storage in a cold environment for prolonged preservation. The interior 18 of cold room 12 is normally cooled by standard refrigeration equipment (not shown) and cold air flow apparatus 10 is operative to alleviate some of the energy needs of the standard refrigerator equipment by introducing cold air from outside of the building walls 16, 17 and to the interior 18 of cold room 12 to assist in maintaining a low temperature environment therein, and at the same time providing for exhaust of warmed air from the interior of cold room 12.

Figure 2:
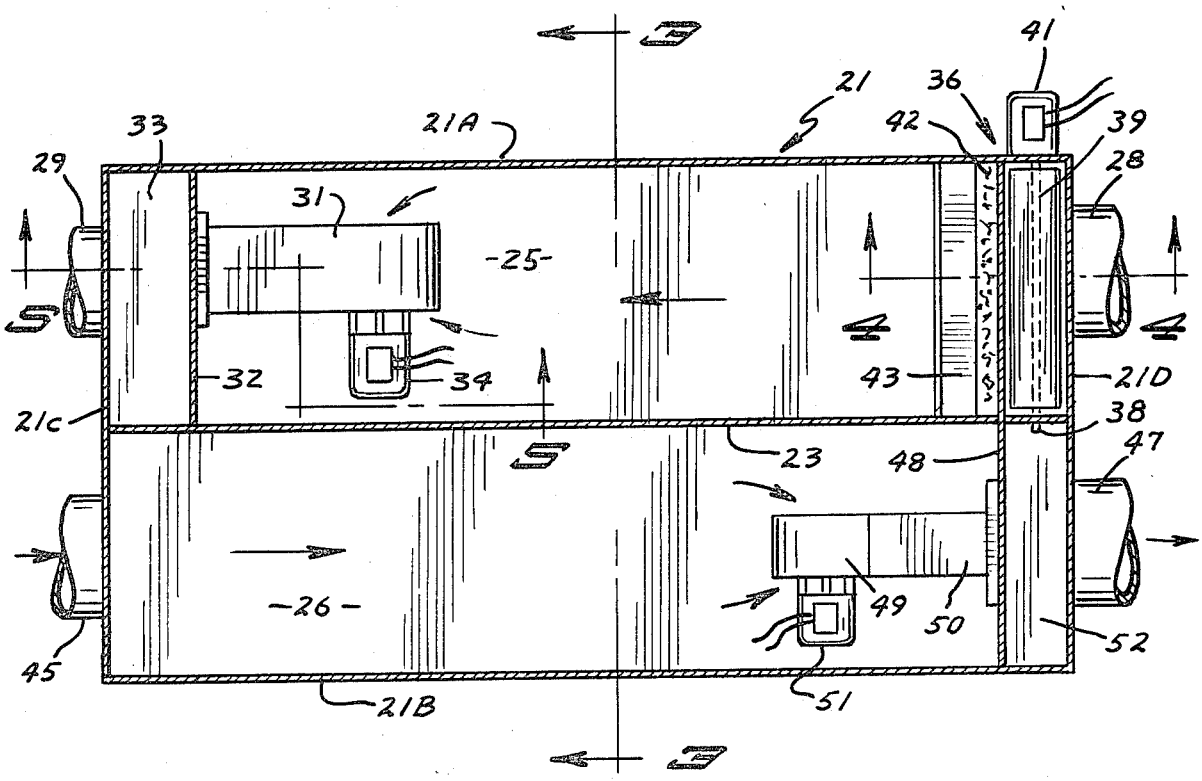
FIG. 2 is an enlarged sectional view of a portion of the cold air flow control apparatus of FIG. 1 taken along the line 2—2 thereof.

As shown in FIGS. 1 and 2, flow control apparatus 10 includes a box-like blower housing 21 fastened by brackets 22 to the outer surface of wall 11 of cold room 12. Housing 21 has laterally spaced side walls 21A and 21B connected to transverse end walls 21C and 21D and top and bottom walls 21E and 21F. The interior of housing 21 is divided by a median portion 23 into an air intake chamber 25 and an air exhaust chamber 26. A first or upstream intake duct 28 extends from the location outside of the building, through an opening in one of the building walls, and to the intake chamber 23 of housing 21. A second or downstream intake duct 29 extends from the opposite end of chamber 25, through an intake opening of wall 11 of cold room 12, and opens into the interior 18 of cold room 12.

The purpose of the upstream and downstream ducts 28, 29 and intake chamber 25 is to provide a conduit for the flow of cold air from a location outside of the building 15 to the interior of cold room 12. An intake blower 31 is mounted on a bulkhead 32 that spans the width of chamber 25 to define a plenum chamber 33. Intake blower 31 is operable by an electric intake blower motor 34 and is positioned to direct air incoming from upstream intake duct 28 through plenum 33 which opens to the downstream intake duct 29.

At the entrance or intake end of chamber 25 where the upstream intake duct 28 opens to the chamber 25 is a power operated louver assembly 36 of a usual and preferred type known in the art. Referring to FIG. 4, louver assembly 36 includes a frame 37 carrying a plurality of transverse, vertically spaced rotatable rods 38. Rods 38 have louver blades 39 mounted for rotation on them for rotation between a vertically orientated, closed orientation and a horizontal, open orientation as shown. In the closed orientation, air is blocked from flowing into the intake chamber 25 through the upstream intake duct 28. This is to close the intake conduit when apparatus 10 is not operating. In the open orientation, air is free to flow from the outside location through the upstream intake duct 28 and into the intake chamber 25. As shown in FIG. 2, a louver assembly motor 41 is provided for opening and closing the louver blades 39. Louver blade assembly motor 41 is electrically associated with intake blower motor 34 such that when intake blower motor 34 is operative, louver blade assembly motor 41 operates to open louver assembly 36. When intake blower motor 34 shuts off, louver assembly motor 41 operates to close louver assembly 36 by rotation of louver blades 39 to the generally vertical orientation.

A filtering system is provided to filter air incoming through upstream intake duct 28 and includes a first filter or pre-filter 42 disposed across a lateral cross section of chamber 25 immediately adjacent the downstream face of louver assembly 36. Pre-filter 42 can be comprised of a rough, fiber material in order to filter out larger particles, such as rain drops or snow flakes coming through with the incoming air. A second filter or fine filter 43 is disposed in parallel relationship to and immediately downstream of the pre-filter 42 and is comprised of a finer filtering material, such as a Heppa filter, in order to filter out the fine dust, dirt and like particles from the incoming air. Other types of filtering mechanisms or assemblies can be employed.

An exhaust duct system includes an upstream exhaust duct 45 open to the interior 18 of cold room 12 at an exhaust vent location 46 and extending to one end of the exhaust chamber 26 on housing 21. A downstream exhaust vent 47 is open to and extends from the opposite end of the exhaust chamber 26 to a location outside of the building 15 at an exhaust vent location 48.

An exhaust blower 49 has an output nozzle 50 orientated to direct air from the exhaust chamber 26 into a plenum chamber 52 and downstream exhaust 47. The discharge end of blower 49 is mounted on a transverse baffle 48. Exhaust blower 49 is driven by exhaust blower motor 51 such that exhaust blower 49 is operative to cause movement of air from within the interior 18 of cold room 12 through the upstream exhaust duct 45, into the exhaust chamber 26 and out through plenum chamber 52 and downstream exhaust duct 47 to be expelled at the exhaust vent location 48.

FIG. 6 diagrammatically depicts the control system for cold air control apparatus 10. Intake blower motor 34, exhaust blower motor 51 and louver assembly motor 41 are all operatively connected through electrical control means indicated schematically at 54. An outside thermal responsive regulator element 55 is located outside of the building 15 at approximately the location from where cold air is drawn in through upstream intake duct 28. Thermal regulator element 55 is operative to sense the ambient temperature and when the ambient temperature is below an upper limit, it is operative to permit operation of cold air flow apparatus 10 by permitting operation of electrical control means 53. When thermal element 55 senses the ambient temperature is above the upper limit, it is operative to prohibit operation of electrical control means 52 as by interrupting a power circuit or the like. An inside thermal responsive control element 56 is located to sense temperature of the interior 18 of cold room 12. Thermal element 56 senses a lower temperature boundary in cold room 12, and an upper temperature boundary. At the upper temperature boundary, thermal element 56 is operative to cause operation of cold air flow control apparatus 10 if permitted by outside thermal element 55. When the inside thermal element 56 senses that the low temperature boundary has been reached, it is operative to shut off the control apparatus 10.

In use of the cold air flow control apparatus 10, for example, in a lower temperature boundary for the temperature inside cold room 12 can be 30° F. (−1° C.) and the high temperature boundary 40° F. (4° C.), with an outside upper temperature limit of 35° F. (2° C.). When the ambient temperature is 35° F. or less, outside thermal element 55 will permit operation of the electrical control means 53. If the ambient outside temperature exceeds 35° F., then the outside thermal element 55 will not permit operation of the electrical control means 53 regardless of the temperature sensed by the inside thermal control element 56, and cold room 12 will be cooled by the standard refrigeration equipment. When outside thermal control element 55 does permit operation of the electrical control means 53, and when the inside thermal control element 56 senses that the upper temperature boundary (40° F.) has been reached, it is operative to cause operation of the electrical control means 53. When this occurs, the intake blower motor 34 is energized as well as the exhaust blower motor 51 and the louver assembly motor 41. The louver assembly 36 is opened and cold air at a temperature of 35° F. or less is drawn through the upstream intake duct 47, through the intake chamber 25, being filtered by the first and second filters 42,43, then moved through the downstream intake duct 29 into the interior 18 of cold room 12, all under the influence of intake blower 31. At the same time, the warmer air in the interior 18 of cold room 12 is passed through exhaust vent 46 and through upstream exhaust duct 45, then through exhaust chamber 26 of housing 21 and lastly through the downstream exhaust duct 47 and out the exhaust vent 48, all under the influence of exhaust blower 49. At the point where the cold air entering the interior of cold room 12 has displaced a sufficient amount of warmer air such that the temperature inside cold room 12 drops to the lower temperature boundary (30° F.), then inside thermal element 56 operates to shut off the electrical control means 53 which shuts off the intake blower motor 34 and exhaust blower motor 51 as well as causing the louver assembly motor 41 to close the louver assembly 36.

It is apparent that the cold air flow control apparatus 10 can be installed in existing buildings to serve existing cold rooms. Alternatively, the apparatus can be installed in new construction and be constructed integrally with the walls of the cold room and building. It would be apparent to those skilled in the art that other deviations of the apparatus can be had without departing from the scope and spirit of the invention.

The embodiments of the invention in which an exclusive property or privilege is claimed are defined as follows:

1. A cold air flow and control apparatus to transfer cold outside air from the exterior of a building to a cold room in the building to supplement the refrigeration provided to the cold room by the usual refrigeration equipment, said apparatus comprising: housing means mounted exteriorly of the cold room having a chamber; air intake means disposed between the interior of the cold room and the exterior of the building to permit movement of cold air from the exterior of the building to the interior of the building comprising an upstream air intake duct extending from a location outside of the building to the intake chamber of the housing, and a downstream air intake duct extending from the intake chamber of the housing to a location inside of the cold room; an intake blower located in the chamber to move cold air through the air intake means from the exterior of the building to the interior of the cold room; air exhaust means allowing air to flow out of the cold room; and control means including outside thermal responsive regulator means operative to prohibit operation of the intake blower when the outside temperature sensed by the control means exceeds a pre-selected upper temperature limit, and operative to permit operation of the intake blower when the outside temperature sensed by the control means is less than said upper temperature limit; said control means also including inside thermal responsive regulator means operable to cause the intake blower to operate when the temperature in the cold room approaches an upper temperature boundary and when the intake blower is permitted to operate by the outside thermal responsive regulator means, and operative to shut off the intake blower when the temperature in the cold room reaches a low temperature boundary.

2. The apparatus of claim 1 wherein: said housing includes an air intake plenum chamber.

3. The apparatus of claim 2 including: air exhaust means leading from inside the cold room to a location outside of the building for movement of air from inside the cold room to a location outside the building.

4. The apparatus of claim 3 wherein: said air exhaust means includes exhaust ducts.

5. The apparatus of claim 3 including: an exhaust blower associated with the exhaust ducts in order to assist in moving air from inside the cold room to a location outside the building.

6. The apparatus of claim 2 including: filter means associated with the intake ducts to filter incoming air.

7. The apparatus of claim 1 including: a louver assembly associated with the air intake means, and power means operable to open and close the louver assembly, said power means being connected to the control means whereby the control means opens the louver assembly when the blower is operating and closes the louver assembly when the blower is not operating.

8. A cold air flow and control apparatus to transfer cold outside air from the exterior of a building to a cold room in the building to supplement the refrigeration provided to the cold room by usual refrigeration equipment, said apparatus comprising: a blower housing, means dividing the blower housing into an intake chamber and an exhaust chamber; air intake means disposed between the interior of the cold room and the exterior of the building to permit movement of cold air from the exterior of the building to the interior of the building; an intake blower located in the intake chamber of the blower housing to move cold air through the air intake means from the exterior of the building to the interior of the cold room; said air intake means including an upstream intake duct extending from a location outside of the building to the intake chamber, and a downstream intake duct extending from the intake chamber of the housing to a location inside the cold room; an exhaust blower located in the exhaust chamber of the housing, air exhaust means including an upstream exhaust duct extending from a location inside the cold room to the exhaust chamber of the housing, and a downstream exhaust duct extending from the exhaust chamber of the housing to a location outside of the building; and control means including outside thermal responsive regulator means operative to prohibit operation of the intake blower when the outside temperature sensed by the control means exceeds a pre-selected upper temperature limit, and operative to permit operation of the intake blower when the outside temperature sensed by the control means is less than said upper temperature limit; said control means also including inside thermal responsive regulator means operable to cause the intake blower to operate when the temperature in the cold room approaches an upper temperature boundary and when the intake blower is permitted to operate by the outside thermal responsive regulator means, and operative to shut off the intake blower when the temperature in the cold room reaches a lower temperature boundary.

9. The apparatus of claim 8 including: a louver assembly located in the intake chamber of the housing adjacent the location where the upstream intake duct empties into the intake chamber.

10. The apparatus of claim 9 including: a filter assembly disposed in the intake chamber adjacent the louver assembly.

11. The apparatus of claim 9 including: power means for opening and closing the louver assembly, said power means being connected to the control means whereby the control means opens the louver assembly when the intake and exhaust blowers are operating and closes the louver assembly when the intake and exhaust blowers are not operating.

12. A cold air flow and control apparatus to transfer cold outside air to a cold room comprising: housing means having outside side and end walls and a median partition defining an air intake chamber and an air exhaust chamber, first intake duct means for carrying outside air to the intake chamber, second intake duct means for carrying air from the intake chamber to the cold room, first means for moving air through the intake chamber and first and second duct means, first exhaust duct means for carrying air from the cold room to the exhaust chamber, second exhaust duct means for carrying air from the exhaust chamber to a selected location, second means for moving air through the exhaust chamber and first and second exhaust duct means, control means including outside thermal responsive regulator means operative to prohibit operation of the first and second means when the outside temperature sensed by the control means exceeds a pre-selected upper temperature limit, and operative to permit operation of the first and second means when the outside temperature sensed by the control means is less than said upper temperature limit, said control means also including inside thermal responsive regulator means operable to cause the first and second means to operate when the temperature in the cold room approaches an upper temperature boundary and when the first and second means is permitted to operate by the outside thermal responsive regulator means, and operative to shut off the first and second means when the temperature in the cold room reaches a low temperature boundary.

13. The apparatus of claim 12 wherein: the first means includes a blower and a motor for operating the blower, said motor being connected to the control means whereby the control means regulates the operation of the motor.

14. The apparatus of claim 13 including: a transverse wall extended across the air intake chamber, and means mounting the blower on the transverse wall, said transverse wall being spaced from an end wall of the housing means to provide a plenum chamber for receiving air from the blower.

15. The apparatus of claim 14 including: louver assembly located in the intake chamber adjacent the location where the first intake duct means directs air into the chamber, power means operable to open and close the louver assembly, said power means being connected to the control means whereby the control means opens the louver assembly when the first and second means are operated and closes the louver assembly when the first and second means is not operated.

16. The apparatus of claim 15 including: air filter means located in the intake chamber adjacent the louver assembly to filter the air moving into the intake chamber.

17. The apparatus of claim 16 wherein: the air filter means includes a pre-filter and a primary filter.

18. The apparatus of claim 12 wherein: the second means includes an exhaust blower and a motor for operating the exhaust blower, said motor for operating the exhaust blower being connected to the control means whereby the control means regulates the operation of said exhaust blower motor.

19. The apparatus of claim 18 including: a transverse wall extended across the air exhaust chamber, and means mounting the exhaust blower on the transverse wall, and transverse wall being spaced from an end wall of the housing means to provide an exhaust plenum chamber for receiving air from the exhaust blower, said second exhaust duct means being in air flow communication with the exhaust plenum chamber.

* * * * *

UNITED STATES PATENT AND TRADEMARK OFFICE

CERTIFICATE OF CORRECTION

PATENT NO. : 4,178,770

DATED : December 18, 1979

INVENTOR(S) : Lyle Fox

It is certified that error appears in the above-identified patent and that said Letters Patent are hereby corrected as shown below:

Column 2, line 31, "portion" should be --partition--.

Signed and Sealed this

*First* Day of *April 1980*

[SEAL]

*Attest:*

SIDNEY A. DIAMOND

*Attesting Officer*

*Commissioner of Patents and Trademarks*